United States Patent [19]

Moore, Jr. et al.

[11] Patent Number: 4,940,042

[45] Date of Patent: Jul. 10, 1990

[54] SYSTEM AND APPARATUS FOR VENTING WATER HEATER

[75] Inventors: Henry J. Moore, Jr., Playa Del Rey; Michael K. Garrett, Lakewood, both of Calif.

[73] Assignee: Mor-Flo Industries, Inc., Cleveland, Ohio

[21] Appl. No.: 235,973

[22] Filed: Aug. 24, 1988

[51] Int. Cl.[5] ..... F24H 1/00

[52] U.S. Cl. ..... 126/344; 126/373; 126/389; 98/34.6

[58] Field of Search ..... 126/374, 389, 390, 391, 126/293, 312, 80, 84, 515, 529, 344, 373, 314, 319, 318, 315; 98/45, 46

[56] References Cited

U.S. PATENT DOCUMENTS

| | | | |
|---|---|---|---|
| 931,824 | 8/1909 | Weinbach et al. | 126/80 |
| 1,790,454 | 1/1931 | Arrowsmith . | |
| 1,795,832 | 3/1931 | Cannon . | |
| 1,829,334 | 10/1931 | Birtch . | |
| 1,859,745 | 5/1932 | Morley . | |
| 1,935,919 | 11/1933 | Ronstrom . | |
| 1,948,064 | 2/1934 | Cartter . | |
| 1,961,231 | 6/1934 | Maier . | |
| 2,443,359 | 6/1948 | Newhouse . | |
| 2,563,817 | 8/1951 | Carson . | |
| 2,728,325 | 12/1955 | Sturma . | |
| 2,790,428 | 4/1957 | Buttler . | |
| 2,888,911 | 6/1959 | Thompson . | |
| 2,951,477 | 9/1960 | Harper . | |
| 3,028,843 | 4/1962 | Carlson et al. . | |
| 3,091,223 | 5/1963 | Vitale . | |
| 3,180,322 | 4/1965 | Gibbard . | |
| 3,349,754 | 10/1967 | Bock . | |
| 3,492,972 | 2/1970 | McLaren . | |
| 3,527,260 | 9/1970 | Kimmel . | |
| 3,601,099 | 8/1971 | Vaillant et al. . | |
| 3,782,303 | 1/1974 | Pfister et al. . | |
| 3,802,397 | 4/1974 | Wariner . | |
| 4,102,632 | 7/1978 | Hastings . | |
| 4,254,759 | 3/1981 | Schmidt . | |
| 4,257,355 | 3/1981 | Cook . | |
| 4,262,608 | 4/1981 | Jackson . | |
| 4,301,772 | 11/1981 | Eising . | |
| 4,328,791 | 5/1982 | Moore, Jr. et al. . | |
| 4,356,794 | 11/1982 | Bouman et al. . | |
| 4,357,909 | 11/1982 | Kagoshima . | |
| 4,397,296 | 8/1983 | Moore, Jr. et al. . | |
| 4,424,792 | 1/1984 | Shimek et al. . | |
| 4,449,484 | 5/1984 | Sakamoto et al. . | |
| 4,485,746 | 12/1984 | Erlandsson . | |
| 4,487,137 | 12/1984 | Horvat et al. . | |
| 4,531,509 | 7/1985 | Wilhelm, Jr. . | |
| 4,549,525 | 10/1985 | Narang | 126/361 |
| 4,557,247 | 12/1985 | Hara et al. | 98/34.6 X |
| 4,664,096 | 5/1987 | Narang | 126/351 |
| 4,793,322 | 12/1988 | Shimek et al. | 126/80 |

OTHER PUBLICATIONS

BGP "Heat Maker" brochure, 1981, BGP Systems, Inc.

Brochure AMT Heat Maker, (no date).

State Water Heaters, brochure, State Industries, Inc., (no date).

AMTI, AMTI Heating Products, Inc. Heatmaker, Bulletin 86-4, Installation & Operating Instructions (pp. 5-10), 3/1986.

*Primary Examiner*—Larry Jones

*Attorney, Agent, or Firm*—Body,Vickers & Daniels

[57] ABSTRACT

A direct venting system for an indoor domestic type water heater vents the combustion chamber of the water heater directly with the outdoor atmosphere by means of natural convection both to supply incoming combustion air and to expel flue gases. A conduit assembly extends from an indoor end associated with the water heater to an outdoor end in communication with the outdoor atmosphere, and provides continuous combustion air inlet and flue gas outlet plenums to isolate the combustion chamber of the water heater from the indoor room air.

12 Claims, 3 Drawing Sheets

SYSTEM AND APPARATUS FOR VENTING WATER HEATER

SYSTEM AND APPARATUS FOR VENTING WATER HEATER

The present invention pertains to the art of gas water heaters, and particularly to a closer system for venting an indoor domestic type gas water heater to the outdoor atmosphere under the force of natural convection.

BACKGROUND OF THE INVENTION

Water heaters for use in the home, apartments, or other relatively small building units having comparable demands for heated water often employ natural gas as the source of heat. Such water heaters usually comprise a cylindrical body including a tank for storage of water to be heated, a cold water inlet, a hot water outlet, and an apparatus for applying heat to the stored water including a natural gas inlet, control valves and associated thermostat mechanisms, and a combustion chamber in which the natural gas is burned and which is adapted to conduct or otherwise convey the heat of combustion to the quantity of stored water.

The lower region of the cylindrical body includes a combustion air inlet opening communicating the combustion chamber with the room air. A vertical flue pipe extends from the combustion chamber through the tank to an open end at the top of the water heater body. A draft hood is provided at the top of the water heater body to make a connection between the open end of the flue pipe and a conduit leading to a chimney or other existing passage to a roof top opening. The draft hood is generally conical, with a wider lower end mounted on brackets in a position raised above the top of the water heater and concentric with the top end of the flue pipe. The narrower upper end of the draft hood is sealed to the chimney conduit. The draft hood thus reaches down from the chimney conduit as a skirt around the end of the flue pipe to define an open annular space therebetween.

Operation of the water heater is usually vented by the force of convection currents caused by the the heat of combustion. Room air is drawn into the combustion chamber through the combustion air inlet opening, and flue gases rise out of the combustion chamber through the flue pipe to the chimney connection. Convective flow of the flue gases out through the chimney is aided by a draft of room air entering the chimney conduit directly through the open skirt arrangement of the draft hood.

Such conventional water heaters have several disadvantages. A particular disadvantage is caused by the use of room air as combustion air for the water. Energy expended to heat, cool, or humidify room air is wasted when that air is drawn into the water heater and driven out through the chimney. Room air continues to exit through the chimney when the heater rests between intermittent heating operations since the heat contained in the tank of water tends to induce a residual convective flow through the heater. In addition to wasting the energy of heating or air conditioning, this continued loss of room air carries with it the heat stored in the tank of water. Furthermore, an outward draft of room air tends to induce an inward draft of outdoor air through door and window frame spaces, which is undesirable in both winter and summer.

Another cause of loss of room air is the open arrangement of the draft hood as a skirt around the top end of the flue pipe. This opening allows a flow of air from the interior of a house out through the chimney.

Another disadvantage is that conventional water heaters can be installed only in locations where a chimney connection can be made. Construction of a chimney to accommodate a water heater in an existing building is likely to be impractical if not impossible and installation in a building which does have a chimney is limited to locations adjacent the chimney which may not be practical for plumbing and/or electrical requirements. It also may not be desirable to design the location and clearance around a chimney in a new building, particularly a home, to accommodate placement of a water heater.

Known domestic type indoor water heaters and associated venting systems thus fail to provide a means for heating water without wasting valuable energy used to heat or otherwise condition indoor room air, and are not readily adaptable to installation in convenient locations in new or existing building structures.

SUMMARY OF THE INVENTION

The present invention overcomes the above referred to disadvantages and others and provides a water heater and direct venting system for venting the combustion chamber of the water heater by natural convection directly with outdoor atmospheric air in isolation from indoor room air.

In accordance with a principal feature of the invention there is provided an indoor domestic type water heater which is vented directly to the outdoor atmosphere by means of natural convective air flow. The water heater includes a combustion chamber with a combustion air inlet opening and a flue gas outlet opening, and a flue pipe rising from the combustion chamber outlet opening to an open end atop the heater. A conduit assembly extends from the heater to an outdoor end in communication with the atmosphere. The conduit assembly includes a first conduit extending from the outdoor end to an indoor position adjacent the open end of the flue pipe, and a closure member making an airtight sealed connection between the first conduit and the flue pipe. A second conduit extends telescopically over the first conduit to define an air flow space between the two conduits, and is joined at the indoor position by duct work which communicates the air flow space between the conduits with the combustion chamber inlet opening of the water heater. The combustion chamber is thereby vented directly to the outdoor atmosphere through a continuous airtight flue plenum defined by the flue pipe, the closure member, and the first conduit; and through a continuous airtight combustion air inlet plenum defined by the second conduit received over the first conduit, and the connective duct work between the second conduit and the combustion chamber.

In accordance with a more specific feature of the invention, the closure member is provided in the form of a closed vent hood which is generally conical. A wide lower end of the closed vent hood is received over the open upper end of the flue pipe and is connected to the top of the water heater with an airtight seal. The narrow upper end of the conical closed vent hood is sealed to the indoor end of the first conduit to make an airtight connection for convective flow between the flue pipe and the first conduit.

In accordance with another specific feature of the invention, the first and second conduits are circular in cross-section and substantially coaxial such that the air flow space therebetween is annular in cross-section. Thus telescopic relationship of the two conduits increases efficiency of the venting system by providing a heat exchanger to preheat the incoming combustion air by conduction from the outgoing flue gases in the first conduit.

A further specific feature of the invention includes the provision of baffles within the water heater adjacent the combustion air inlet opening which restrict the residual convective flow during inoperative periods of the water heater to reduce heat loss from the tank of water.

Yet another specific feature of the invention is that the conduit assembly may extend from the water heater either vertically to an exposed roof or horizontally to an exterior building wall. The invention is thus adaptable for installation independently of a chimney in basements, garages, or other locations not associated with a chimney.

In accordance with another principal feature of the invention there is provided a direct venting system for venting a domestic indoor water heater directly to the outdoor atmosphere by means of natural convection. The venting system comprises a conduit assembly having an indoor end associated with the water heater and an outdoor end communicating with the outdoor atmosphere. The conduit assembly includes a continuous combustion air inlet plenum extending from the outdoor end to the combustion air inlet opening of the water heater, and a continuous flue gas outlet plenum extending from the open upper end of the water heater flue pipe to the outdoor end of the conduit assembly through a conduit which extends through and within the combustion air inlet plenum. The inlet and outlet plenums are thus telescopically coextensive between the indoor and outdoor ends of the conduit assembly so that a direct venting connection can conveniently be made between a water heater and the outdoor atmosphere by a closed unitary member of the venting system reaching from any indoor location to an exterior building wall or an exposed roof.

In accordance with a more specific feature of the invention, duct work is provided to complete a section of the continuous combustion air inlet plenum at the indoor end of the conduit assembly between the telescopic conduits and the combustion chamber of the water heater. The duct work is adapted to provide air to the combustion chamber in a wide, slow flow as compared to the rapid flow of fluid gases being driven out by the heat of combustion. This advantageously insures that natural convection alone will provide a sufficient volume of combustion air adjacent the inlet opening.

In accordance with yet another principal feature of the invention, the natural convection direct venting system for an indoor water heater is comprised of a conduit assembly and a cap assembly. The conduit assembly includes a first conduit extending within a second conduit to define an outer air plenum between the two conduits and an inner air plenum within the first conduit. The cap assembly is associated with the outdoor end of the conduit assembly, and is adapted to separately communicate the inner and outer air plenums with outdoor atmosphere.

Another specific feature of the invention is an arrangement wherein the inlet plenum has a cross-sectional area at the telescopic section of the conduit assembly which is substantially greater than the cross-sectional area of the corresponding section of the outlet plenum. This arrangement reduces resistance to the convective inlet flow and promotes preheating of the combustion air.

In accordance with another specific feature of the invention, the first conduit extends beyond the second conduit, and the cap assembly includes a shield disposed about the periphery of the extended portion of the first conduit to block air flow directly between the two air plenums. The two air plenums are thereby separately open to the outdoor atmosphere.

In accordance with another specific feature of the invention, the cap assembly includes a first screen cover extending from the shield longitudinally towards the extended portion of the first conduit in the form of a sleeve received over that portion of the first conduit, and a second screen cover extending longitudinally from the shield toward the second conduit. The screen covers may be perforated to permit air flow directly between the associated plenums and the outdoor atmosphere, or in an alternate embodiment may be solid in the form of a skirt or a wind band to permit only indirect air flow through the sleeve interiors between the associated plenums and the outdoor atmosphere. In either embodiment the screen covers serve to prevent foreign objects and wind gusts from entering the venting system. Preferably, the conduits and screen covers are coaxial and circular in cross-section.

The principal object of the present invention is to provide a domestic type indoor water heater and associated venting system which directly vent the combustion chamber of the water heater with outdoor atmosphere by means of natural convection both to supply incoming combustion air and to expel flue gases.

Another object of the invention is to provide a natural convection direct venting system for a domestic indoor water heater which vents the heater to the outdoor atmosphere in isolation from room air, and which is readily adaptable for installation with a conventional water heater.

A further object of the invention is to provide a natural convection direct venting system for an indoor domestic water heater which is readily adaptable for installation to communicate the water heater with the outdoor atmosphere from indoor locations not associated with a chimney, such as in garages, workshops, or other buildings not having a chimney.

Another object of the inventor is to provide a cap assembly for the outdoor end of the venting system which enables separate communication of the inlet and outlet openings of the water heater combustion chamber with outdoor atmosphere.

BRIEF DESCRIPTION OF THE DRAWINGS

These and other objects of the invention will become apparent from the following detailed discussion of a preferred embodiment and from the accompanying drawings wherein.

DESCRIPTION OF A PREFERRED EMBODIMENT

Figure 1:
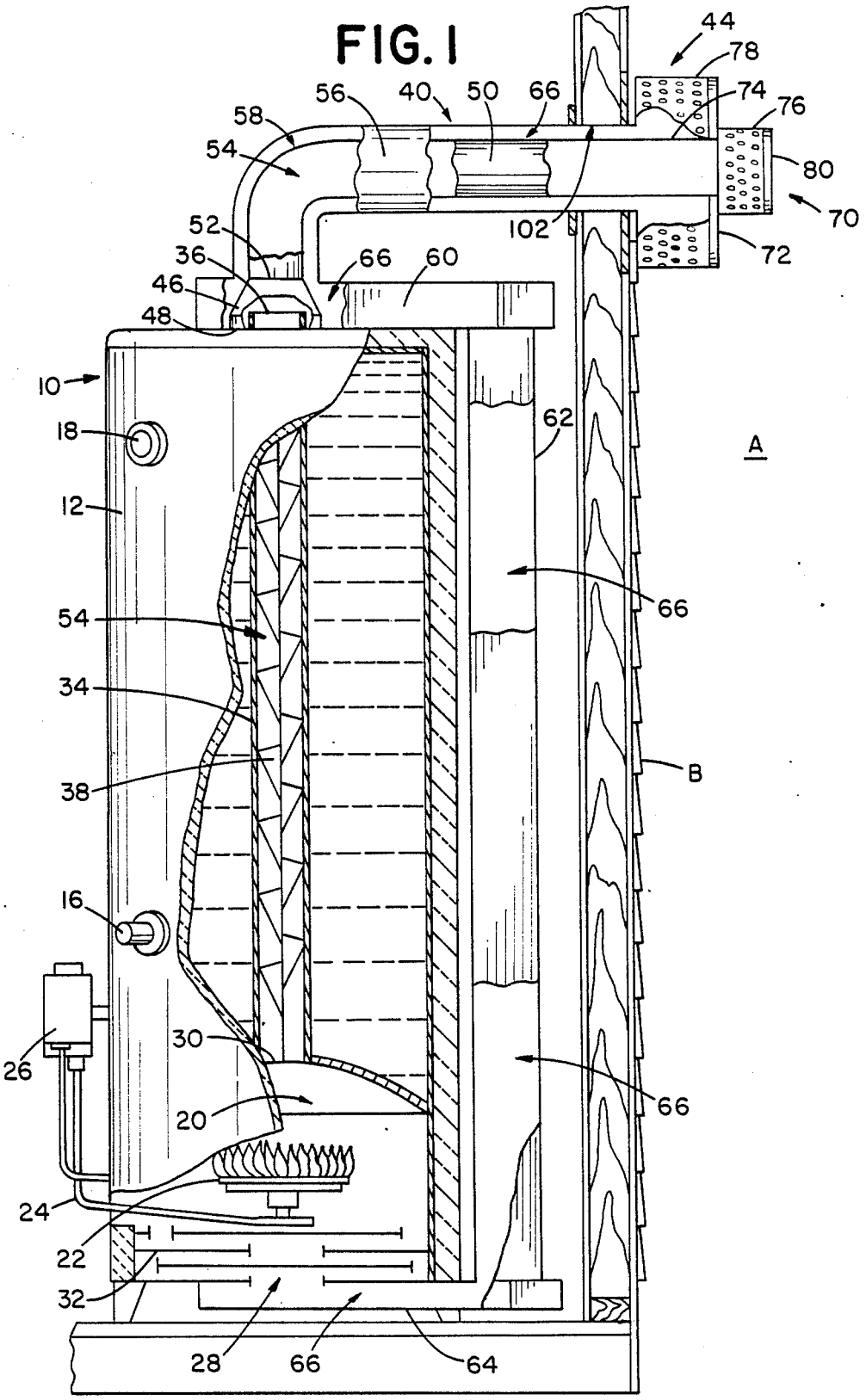
FIG. 1 is a side elevational view, partially in section, of a water heater and direct vent system in accordance with the invention.

Referring now to the drawings wherein the showings are for the purpose of illustrating a preferred embodiment of the invention only and not for the purpose of limiting same, in FIG. 1 there is shown a partially sectional view of an indoor domestic type water heater adapted in accordance with the present invention. The water heater 10 is comprised of conventional components including a cylindrical body 12 containing a tank 14 adapted to hold a quantity of water to be heated. Associated with the tank 14 is a cold water inlet 16 and a hot water outlet 18. Disposed beneath the tank 14 is a combustion chamber 20 housing a burner 22 which is connected to a source of natural gas fuel by a fuel line 24. Associated with the fuel line 24 at the exterior of the water heater body 12 is a gas control valve apparatus 26 which is operatively connected with a water temperature responsive thermostat means, which may be of conventional construction and is not shown in the drawings.

In accordance with the invention the water heater 10 is provided with a direct vent system communicating the combustion chamber 20 with the outdoor atmosphere A. The direct vent system comprises a combustion air inlet opening 28 at a position vertically below the burner 22, and a flue gas outlet opening 30 at a position vertically above the burner 22. Baffles 32 are disposed between the combustion air inlet opening 28 and the burner 22. A flue pipe 34 extends vertically from the combustion chamber outlet opening 30 through the tank 14 to reach an open upper end 36 at the top of the water heater body 12. The flue pipe 34 may also include baffles 38 to conduct heat to the water in the tank 14.

The direct vent system further comprises a conduit assembly 40 having an inner end 4Z associated with the water heater 10, and an outer end 44 at the exterior of building B. A closure member in the form of a vent hood 46 is positioned substantially concentrically over the open upper end 36 of the flue pipe 34. The vent hood 46 is generally conical and has a wider lower end 48 attached to the upper surface of the water heater body 12 with an airtight seal. A first conduit 50 is joined to the narrower upper end 52 of the closed vent hood 46 with an airtight seal, and extends therefrom to the outdoor end 44 of the conduit assembly 40 at the exterior of the building B. The vent hood 46 thus joins the flue pipe 34 and the first conduit 50 in an airtight sealed relationship whereby a continuous flue plenum 54 is defined to extend from the combustion chamber outlet opening 30 through the flue pipe 34 and the first conduit 50 to the outdoor atmosphere A.

A second conduit 56 is received substantially concentrically over the first conduit 50 and extends from a position adjacent the closed vent hood 56 along the length of the first conduit 50 to the outdoor end 44 of the conduit assembly 40 to define an annular plenum 58 between the first conduit 50 and the second conduit 56. An upper connecting duct 60 communicates the annular plenum 58 with a third conduit 62. The third conduit 62 extends from the upper connecting duct 60 to a lower connecting duct 64 which communicates the third conduit 62 with the combustion chamber inlet opening 28. Airtight seals are provided at the connections between the conduits and the associated connecting ducts whereby a continuous combustion air inlet plenum 66 is defined to extend from the outdoor atmosphere A through the annular plenum 58 to the upper connecting duct 60, and further from the upper connecting duct 60 through the third conduit 62 and the lower connecting duct 64 to the combustion chamber inlet opening 28.

Associated with the outdoor end 44 of the conduit assembly 40 is a cap assembly 70. The first conduit 50 extends beyond the end of the second conduit 56 at the outdoor end 44 of the conduit assembly 40 and thereby extends into the cap assembly 70. The cap assembly 70 includes a shield 72 mounted on the extended portion 70 of the first conduit 50, a first screen cover 76 on one side of the shield 72, and a second screen cover 78 on the other side of the shield 72.

Figure 2:
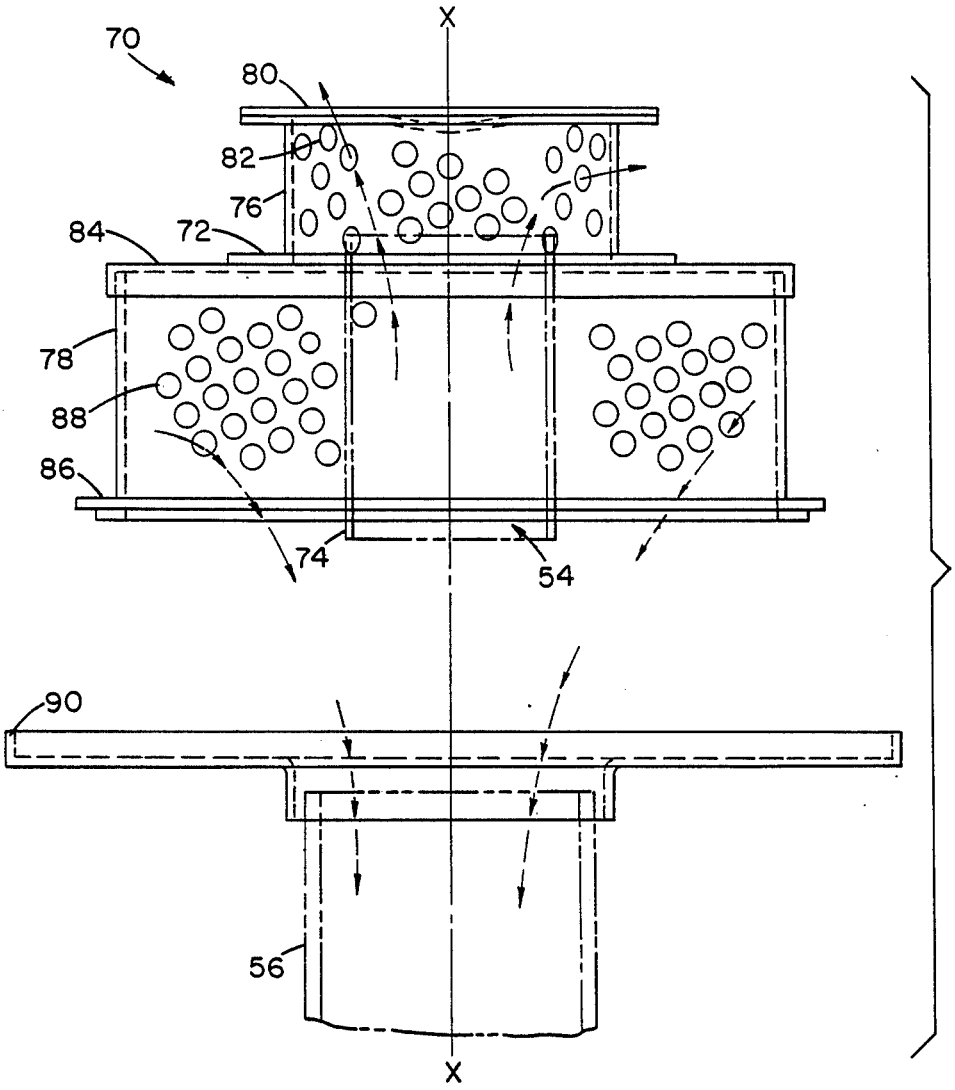
FIG. 2 is a cross-sectional view of a cap assembly in accordance with the invention.

One embodiment of the cap assembly 70 is shown in FIG. 2. The first and second conduits 50, 54 are circular in cross-section and are coaxial with respect to a central axis X. The first and second screen covers 76 and 78 are also circular in cross-section and coaxial with respect to the central axis X, with the first screen cover 76 being disposed radially inwardly of the second screen cover 78. An end piece 80 is provided to close the open end of the first screen cover 76, and perforations 82 are provided to permit air flow between the flue plenum 54 and the outdoor atmosphere A as indicated by the arrows shown in FIG. 2. The second screen cover 78 extends between a first support flange 84 and a second support flange 86. The support flanges 84, 86 serve to rigidify the second screen cover 78, with the first support flange 84 further acting as an extension of the shield 72 to block air flow directly from the first screen cover 76 to the second screen cover 78 in the general direction of the axis X. The second screen cover 78 is provided with additional perforations 88 to permit air flow directly between the outdoor atmosphere A and the combustion air inlet plenum 66 as indicated by the arrows shown in FIG. 2. A mounting bracket 90 is adapted to register with the second support flange 86 and to enable mounting of the cap assembly 70 onto the outdoor end 44 of the conduit assembly 40 at the end of the second conduit 56 as shown.

Figure 3:
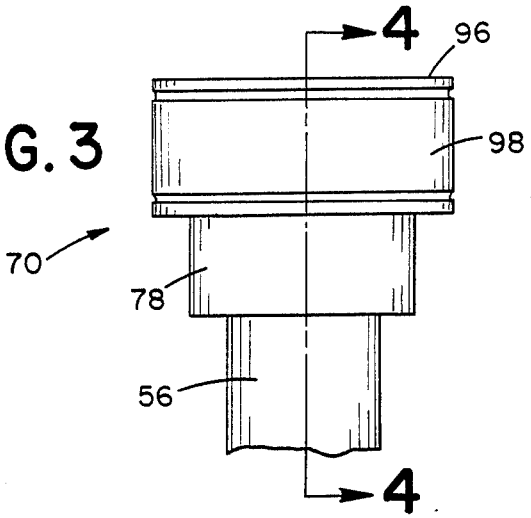
FIG. 3 is an elevational view of an alternate embodiment of a cap assembly in accordance with the invention; and, FIG. 4 is a cross-sectional view taken on line 4—4 of FIG. 3.
Figure 4:
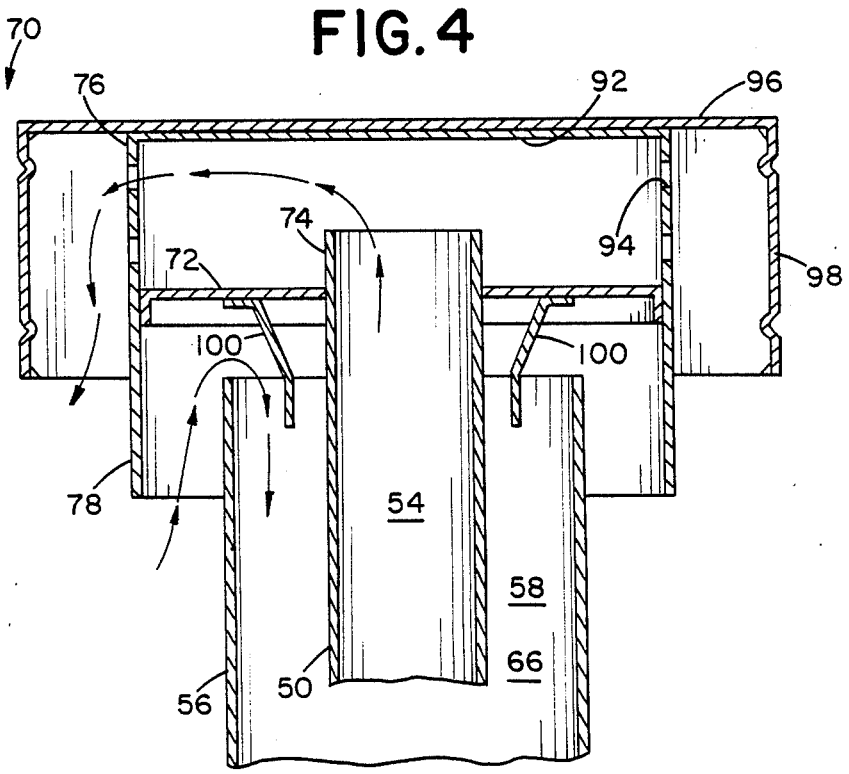

Another embodiment of the cap assembly 70 is shown in FIGS. 3 and 4. In that embodiment the first conduit 50 and the second conduit 56 are circular in cross-section and coaxial about the central axis X. The first and second screen covers 76, 78 are also circular in cross-section, are equally spaced radially with respect to the central axis X, and are joined axially by the shield 72. The first screen cover 76 is provided with an end closure member 92 and with apertures 94 adapted to permit air flow between the flue plenum 54 and the outdoor atmosphere A, as indicated by the arrows shown in FIG. 4. The second screen cover 78 is formed as a continuous skirt around the second conduit 56 and is open in an axial direction away from the shield 72 to permit air flow between the outdoor atmosphere A and the combustion air inlet plenum 66, as indicated in the figure. A wind hood is comprised of a cap piece 96, and a shroud piece 98 spaced radially outwardly from the first and second screen covers 76 and 78 to protect the air flow paths shown in the figure from wind gusts and foreign objects. The cap assembly may be mounted on the second conduit 56 by brackets 100.

Operation of the water heater and direct vent system in accordance with the invention proceeds with a convective flow of air directly between the combustion chamber 20 and the outdoor atmosphere A completely in isolation from the indoor room air. Ignition and combustion of the natural gas fuel at the burner 22 causes a draft of the air within the combustion chamber 20 and of the flue gases produced by combustion at the burner 22 upwardly through the combustion chamber outlet opening 30 and into the flue pipe 34. Air is thereby drawn upwardly through the combustion chamber inlet opening 28 from the lower connecting duct 64. Isolation of the combustion chamber 20 from the surrounding room air causes an initial inlet draft in the lower connecting duct 64 corresponding to the outlet draft initially developed in the flue pipe 34. As combustion proceeds, the draft through the combustion chamber 20 draws a convective venting flow inwardly from the outdoor atmosphere A through the continuous air tight combustion air inlet plenum 66, and drives it outwardly to the outdoor atmosphere A through the continuous airtight flue plenum 54. The shield 72 at the cap assembly 70 prevents the flue gases exiting from the outdoor end of the flue plenum 54 from returning directly into the combustion air inlet plenum 66 with the incoming atmospheric combustion air.

Efficiency of the convective venting in accordance with the invention is found to be enhanced by providing the combustion air inlet plenum 66 with a rear cross-sectional area than the flue plenum 54. Since the lower wall 15 of the tank 14, the flue pipe 34, and the flue baffles 38 all become heated during operation of the burner 22, the flue gases rising through the flue pipe 34 are caused to expand and be further driven convectively by the heat present in those components as well as by the convective force developed by the burning fuel in the combustion chamber 20. The flue gases are thus driven out of the water heater at a high flow rate. Provision of a relatively wide combustion air inlet plenum at the combustion chamber inlet opening 28 enables a corresponding volume of combustion air to immediately enter the combustion chamber 20 at a relatively lower flow rate. A more restricted inlet flow through a narrower combustion air inlet plenum could fail to provide the volume required to match the forcefully driven outlet flow of flue gases.

A relatively slower flow rate through the combustion air inlet plenum 66 further enhances efficiency of the invention where the conduit assembly 40 includes the first and second conduits 50 and 56 in a coaxial heat exchanging relationship. A slower flow rate through the annular plenum 58 enables the incoming combustion air to remain in a heat conducting relationship with the outgoing flue gases in the first conduit 50 long enough for the combustion air to become somewhat preheated whereby heat loss through the flue plenum 54 to the outdoor atmosphere A is reduced and combustion efficiency in the combustion chamber 20 is increased. Effective preheating and convective low rates are found to be obtained with a structural relationship of relative first and second conduit diameters in the ratio of 5:3, for example 5 inches and 3 inches, whereby the annular plenum 58 has a cross-sectional area nearly twice the area of the first conduit 50.

Wben the burner 22 is not in operation, the heat retained by the tank 14 and associated heated components may cause a residual convective flow to continue through the system, although not at the driven rate obtained when the burner 22 is operating. The baffles 32 serve to restrict such a residual convective flow rate through the combustion chamber 20 and thereby reduce any consequent heat losses.

Installation of the invention can be made with a water heater particularly adapted with a direct vent system as shown in the Figures, or as an adaptation to an existing conventional water heater In either case, the indoor location of a water heater can be selected without regard to the location or existence of a chimney and without the need of a powered blower. As shown in FIG. 1, the conduit assembly 40 may be turned to extend horizontally towards a building side wall which will require only a simple opening 102 to permit passage of the conduit assembly 40 to an outdoor venting position. This installation arrangement is especially convenient when a water heater must be installed in a basement or other location remote from either a chimney or the roof of the building. Alternately, the conduit assembly 40 may extend vertically to the roof of a building such as a garage or workshop which would not have a chimney.

A conventional water heater may be adapted in accordance with the invention in order to replace an existing open room air tyPe venting system with a closed atmospheric direct vent system. Removal of a conventional draft hood should ordinarily provide clearance at the top of a water heater for placement of a closure member such as the closed vent hood 46. The first and second conduits 50, 56 would be installed as described above to complete the flue plenum 54 and to provide the combustion air inlet plenum 66 to the extent of the annular plenum 58. The balance of the continuous combustion air inlet plenum 66 could either be provided by the upper and lower connecting ducts 60, 64 and the third conduit 62 as described above, or in any other configuration of duct work and/or conduits whereby a continuous airtight extension to the annular plenum 58 is constructed with sufficiently low resistance to air flow to provide the required volume of combustion air at the combustion air inlet opening of the water heater.

The invention has been described with reference to the preferred embodiment. Obviously, modifications and alterations will occur to others upon the reading and understanding of the specification. It is intended to include all such modifications insofar as they come within the scope of the appended claims or the equivalence thereof.

Having thus described the invention, it is claimed:

1. An indoor domestic type water heater vented directly to outdoor atmosphere under the force of natural convection and comprising:

a generally cylindrical water heater body having a generally flat horizontal top surface, a bottom and a vertical side wall including a combustion chamber having a burner, a combustion air inlet opening and a flue gas outlet opening, and a flue pipe extending vertically from said outlet opening to an open end at the top of said water heater body;

a first conduit assembly extending from said water heater to an outdoor end communicating with outdoor atmosphere, said conduit assembly comprising a first conduit extending from said outdoor end of said conduit assembly to an indoor position adjacent said upper end of said fluid pipe, a closure member defining an airtight convective flow space between said first conduit at said indoor position and said open upper end of said flue pipe, a second conduit received telescopically over said first conduit to define an air flow plenum between said first and second conduits, said second conduit extending from said outdoor end of said conduit assembly to said indoor position of said first conduit;

duct work extending from said second conduit at said indoor position to said combustion air inlet opening, said duct work comprising an upper connecting duct extending horizontally radially outwardly from said air flow plenum at said top of said water heater body to said water heater body side wall, a vertical duct extending downwardly from said upper connecting duct to said water heater body bottom and a lower connecting duct extending from said vertical duct across the bottom of said water heater body to said combustion air inlet opening, said upper connecting duct, said vertical duct and said bottom connecting duct defining an airtight convective flow space communicating said air flow plenum with said combustion chamber; and, said water heater body further includes air flow baffles within said water heater body adjacent said combustion air inlet opening and below said burner and above said inlet opening;

said inlet opening being positioned directly below said baffle, whereby all combustion air must flow through said inlet opening and around said baffle.

2. A water heater as defined in claim 1, wherein said closure member is formed as a generally conical closed vent hood with a wider lower end received substantially coaxially over said open upper end of said flue pipe and attached to said top surface of said water heater body with an airtight seal, and a narrower upper end connected to said first conduit with an airtight seal.

3. A water heater as defined in claim 1, wherein said conduit assembly extends from said water heater directly to a building roof structure through which said conduit assembly further extends to said outdoor end thereof in communication with outdoor atmosphere.

4. A water heater as defined in claim 1, wherein said duct work adjacent said combustion air inlet opening has a cross-sectional area greater than the cross-sectional area of said flue tube.

5. An indoor domestic type water heater vented directly to outdoor atmosphere under the force of natural convection and comprising:

a generally cylindrical water heater body having a generally flat horizontal top surface, a bottom and a vertical side wall including a combustion chamber having a burner, a combustion air inlet opening and a flue gas outlet opening, and a flue pipe extending vertically from said outlet opening, and a flue pipe extending vertically from said outlet opening to an open upper end at the top of said water heater body;

a first conduit assembly extending from said water heater to an outdoor end communicating with outdoor atmosphere, said conduit assembly comprising a first conduit having a diameter and a horizontal outdoor end and extending from said outdoor end of said conduit assembly to an indoor position adjacent said open upper end of said flue pipe, a closure member defining an airtight convective flow space between said first conduit at said outdoor position and said open upper end of said flue pipe, a second conduit having a diameter and a horizontal outdoor end received telescopically over said first conduit to define an air flow plenum between said first and second conduits, said second conduit extending from said outdoor end of said conduit assembly to said indoor position of said first conduit, said first conduit extending outwardly beyond said outdoor end of said second conduit;

duct work extending from said second conduit at said indoor position to said combustion air inlet opening, said duct work comprising an upper connecting duct extending horizontally radially outwardly from said air flow plenum at said top of said water heater body to said water heater body side wall, a vertical duct extending downwardly from said upper connecting duct to said water heater body bottom and a lower connecting duct extending from said vertical duct across the bottom of said water heater body to said combustion air inlet opening, said upper connecting duct, said vertical duct and said bottom connecting duct defining an airtight convective flow space communicating said air flow plenum with said combustion chamber; and a vertical cap assembly comprising an imperforate skirt around said second conduit and said second conduit vertical outside end, an annular imperforate shield disposed upwardly from said end of said second conduit extending from said first conduit to said skirt, a perforated vertical screen cover having a top coaxial with said skirt extending upwardly from said shield, an imperforate closure member closing said screen cover top and a wind band coaxial with said screen cover and spaced outwardly from said screen cover in the axial direction.

6. A water heater as defined in claim 5, wherein said water heater body further comprises airflow baffles within said water heater body adjacent said combustion air inlet opening and below said burner.

7. An indoor domestic type water heater vented directly to outdoor atmosphere under the force of natural convection and comprising:

a generally cylindrical water heater body having a generally flat horizontal top surface, a bottom and a vertical side wall including a combustion chamber having a burner, a combustion air inlet opening and a flue gas outlet opening, and a flue pipe extending vertically from said outlet opening to an open upper end at the top of said water heater body;

a first conduit assembly extending from said water heater to an outdoor end communicating with outdoor atmosphere, said conduit assembly comprising a first conduit having a diameter and a horizontal outdoor end and extending from said outdoor end of said conduit assembly to an indoor position adjacent said open upper end of said flue pipe, a closure member defining an airtight convective flow space between said first conduit at said indoor position and said open upper end of said flue pipe, a second conduit having a diameter and a horizontal outdoor end received telescopically over said first conduit to define an air flow plenum between said first and second conduits, said second conduit extending from said outdoor end of said conduit assembly to said indoor position of said first conduit, said first conduit extending outwardly beyond said outdoor end of said second conduit;

duct work extending from said second conduit at said indoor position to said combustion air inlet opening, said duct work comprising an upper connecting duct extending horizontally radially outwardly from said air flow plenum at said top of said water heater body to said water heater body side wall, a vertical duct extending downwardly from said upper connecting duct to said water heater body bottom and a lower connecting duct extending from said vertical duct across the bottom of said water heater body to said combustion air inlet opening, said upper connecting duct, said vertical duct and said bottom connecting duct defining an airtight convective flow space communicating said air flow plenum with said combustion chamber; and, a cap assembly comprising an annular imperforated shield having a diameter greater than said second conduit diameter and an outside edge, said shield being fixed to said first conduit near said first conduit end, a first cylindrical perforate screen fixed to said shield outside edge and extending toward said second conduit end, a second cylindrical perforate screen fixed to said shield and extending away from said second conduit and having an outboard end, and an end piece fixed to said outboard end of said second perforate screen.

8. A water heater as defined in claim 7, wherein said water heater body further comprises airflow baffles within said water heater body adjacent said combustion air inlet opening and below said burner.

9. A direct vent system for venting an indoor domestic type water heater having a combustion means, said system adapted to vent said heater directly to the outdoor atmosphere under the force of natural convection and comprising:

a conduit assembly extending from said water heater to a vertical end and including a first conduit having a vertical outside end and second conduit having a vertical outside end, said first conduit providing an inner air plenum and extending within said second conduit and coaxial therewith to define an outer air plenum between said conduits, said first conduit extending beyond the end of said second conduit; and, a vertical cap assembly comprising an imperforate skirt around said second conduit and said second conduit vertical outside end, an annular imperforate shield disposed upwardly from said end of said second conduit extending from said first conduit to said skirt, a perforated vertical screen cover having a top coaxial with said skirt extending upwardly from said shield, an imperforate closure member closing said screen cover top and a wind band coaxial with said screen cover and spaced outwardly from said screen cover in the axial direction.

10. The venting system of claim 9 wherein said conduits, skirt, screen cover and wind band are cylindrical.

11. A direct vent system for venting an indoor domestic type water heater having a combustion means, said system adhered to vent said heater directly to the outdoor atmosphere under the force of natural convection and comprising:

a conduit assembly extending from said water heater to a horizontal outdoor end and including a first conduit having a diameter and a horizontal outside end and a second conduit having a diameter and a horizontal outside end, said first conduit providing an inner air plenum and extending within said second conduit and coaxial therewith to define an outer air plenum between said conduits, said first conduit extending beyond the end of said second conduit; and, a cap assembly comprising an annular imperforate shield having a diameter greater than said second conduit diameter and an outside edge, said shield being fixed to said first conduit near said first conduit end, a first cylindrical perforate screen fixed to said shield outside edge and extending toward said second conduit end, a second cylindrical perforate screen fixed to said shield and extending away from said second conduit end and having an outboard end, and an end piece fixed to said outboard end of said second perforate screen.

12. The venting system of claim 11 wherein said end piece is imperforate.

* * * * *